US008167148B2

(12) United States Patent
Jacobson

(10) Patent No.: US 8,167,148 B2
(45) Date of Patent: May 1, 2012

(54) CONVERTIBLE INSTRUMENT RACK

(75) Inventor: Kenneth E. Jacobson, Owatonna, MN (US); Dorothy Ann Jacobson, legal representative, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 323 days.

(21) Appl. No.: 12/356,925

(22) Filed: Jan. 21, 2009

(65) Prior Publication Data

US 2009/0184074 A1 Jul. 23, 2009

Related U.S. Application Data

(60) Provisional application No. 61/021,918, filed on Jan. 18, 2008.

(51) Int. Cl.
*A47F 7/00* (2006.01)

(52) U.S. Cl. ..... 211/85.6; 108/193; 84/387 A

(58) Field of Classification Search ..... 211/5, 19, 211/20, 23, 24, 40, 41.1, 41.12, 41.13, 41.14, 211/41.15, 41.16, 41.17, 41.18, 41.2, 41.6, 211/60.1, 64, 85.6, 89.01, 123, 184, 189, 211/190, 191, 204, 206; 108/106–109, 147.16, 108/193; 248/129; 206/314, 443; 84/327, 84/329, 376 A, 387 A, 421
See application file for complete search history.

(56) References Cited

U.S. PATENT DOCUMENTS 910,659 A * 1/1909 Ford ..... 211/85.26
1,043,501 A 11/1912 Ball
1,464,279 A * 8/1923 Hindley ..... 248/125.1
1,565,464 A 12/1925 Kay
1,570,168 A 1/1926 Mortensen
1,646,165 A * 10/1927 Naujoks et al. ..... 248/125.8
2,058,184 A 10/1936 Sherrard
2,262,556 A * 11/1941 Richmond ..... 84/385 R
2,455,821 A * 12/1948 Stenger ..... 211/85.6
2,550,793 A * 5/1951 Ferriera ..... 248/163.1
2,575,540 A * 11/1951 Wenger ..... 297/186
2,899,163 A 8/1959 Rauk
3,024,690 A 3/1962 Sanstead
3,193,325 A 7/1965 Wenger
3,259,428 A 7/1966 Wenger et al.
D211,034 S 5/1968 Mero
3,540,752 A 11/1970 Anuskiewicz et al.
3,811,357 A 5/1974 Stewart
3,889,814 A 6/1975 Rice
3,958,786 A 5/1976 Mann
4,036,462 A * 7/1977 Sheftel ..... 248/166

(Continued)

OTHER PUBLICATIONS

Amadeus Equipment; On-line catalog featuring instrument storage products; 3 pages; http://www.amadeus-equipment; Nov. 16, 2007.

(Continued)

*Primary Examiner* — Darnell Jayne
*Assistant Examiner* — Joshua Rodden
(74) *Attorney, Agent, or Firm* — Patterson Thuente Christensen Pedersen, P.A.

(57) ABSTRACT

A convertible instrument rack includes a frame and multiple yoke sets. The frame includes support members and the yoke sets each include at least three yoke members which are each placed on a respective one of the support members. The respective position of the support members can be selectively shifted on the frame and the yoke members can be selectively shifted along their respective support member to accommodate tubas or sousaphones, as well as tubas or sousaphones of different sizes.

17 Claims, 21 Drawing Sheets

U.S. PATENT DOCUMENTS

| | | | | | |
|---|---|---|---|---|---|
| 4,065,994 | A | | 1/1978 | Streit | |
| 4,067,527 | A | | 1/1978 | Streit | |
| 4,205,818 | A | | 6/1980 | Lawler | |
| 4,345,732 | A | | 8/1982 | Gallegos | |
| 4,352,480 | A | * | 10/1982 | Gathright | 248/448 |
| 4,441,683 | A | | 4/1984 | Mayne | |
| 4,643,476 | A | | 2/1987 | Montgerard | |
| 4,684,091 | A | | 8/1987 | Moreschi | |
| 4,696,122 | A | * | 9/1987 | Van Der Zyl | 43/21.2 |
| 4,754,711 | A | | 7/1988 | Solomon | |
| 4,986,158 | A | * | 1/1991 | Johnson | 84/327 |
| 5,165,552 | A | * | 11/1992 | Muhlbauer | 211/85.6 |
| 5,464,236 | A | | 11/1995 | Benting et al. | |
| 5,478,145 | A | * | 12/1995 | Kamachi | 312/263 |
| 5,495,951 | A | | 3/1996 | Biasini | |
| 5,536,078 | A | * | 7/1996 | Novikoff | 312/195 |
| 5,789,687 | A | | 8/1998 | Johnson | |
| 6,182,874 | B1 | | 2/2001 | Feldman, Jr. | |
| 6,220,459 | B1 | | 4/2001 | Runyon | |
| 6,296,213 | B1 | | 10/2001 | Law, III et al. | |
| 6,471,078 | B2 | | 10/2002 | Pyle | |
| 6,485,037 | B1 | | 11/2002 | Sulcer, Jr. | |
| 6,540,182 | B1 | | 4/2003 | Wilfer | |
| 6,696,628 | B2 | | 2/2004 | Yoshida | |
| 6,800,798 | B2 | | 10/2004 | Hsieh | |
| 6,945,396 | B2 | | 9/2005 | Dimbath | |
| 7,185,899 | B2 | | 3/2007 | Thiede et al. | |
| 2004/0144233 | A1 | * | 7/2004 | Hsieh | 84/327 |
| 2005/0230334 | A1 | * | 10/2005 | MacDonald et al. | 211/64 |
| 2006/0131251 | A1 | * | 6/2006 | Stadler | 211/85.6 |
| 2006/0201898 | A1 | * | 9/2006 | Hughes | 211/64 |

OTHER PUBLICATIONS

Sherrard Products at Woodwind & Brasswind; 4 pages; http://www.wwbw.com/Sherrard-c61+429439154.music; Nov. 16, 2007.

Black Cat Music Company; On-line catalog featuring instrument storage products; Cello Rack 4-Unit instrument storage; Instrument and Sheet Music Storage; 2 pages; http://www.blackcatmusic.co.uk/products/storage/instrument-storage/cello-rack-4-unit; Nov. 16, 2007.

Black Cat Music Company; On-line catalog featuring instrument storage products; Cello Rack 6-Unit Instrument Storage; 1 page; http://www.blackcatmusic.co.uk/products/storage/instrument-storage/cello-rack-6-unit; Nov. 16, 2007.

Black Cat Music Company; On-line catalog featuring instrument storage products; Bass Rack 3-Unit Instrument Storage; 1 page; http://www.blackcatmusic.co.uk/products/storage/instrument-storage/cello-rack-3-unit; Nov. 16, 2007.

Black Cat Music Company; On-line catalog featuring instrument storage products; Bass Rack 4-Unit Instrument Storage; 1 page; http://www.blackcatmusic.co.uk/products/storage/instrument-storage/cello-rack-4-unit; Nov. 16, 2007.

Black Cat Music Company; On-line catalog featuring instrument storage products; Violin/Viola Rack Instrument Storage; 1 page; http://www.blackcatmusic.co.uk/products/stroage/instrument-storage/violin-viola-rack; Nov. 16, 2007.

Black Cat Music Company; On-line catalog featuring instrument storage products; 3-Tier Violin/Viola Rack Instrument Storage; 3 pages; http://www.blackcatmusic.co.uk/products/storage/instrument-storage/3-tier-violin-viloa-r; Nov. 16, 2007.

Sherrardracks; Sherrard "Roll-Away" Musical Instrument Racks; 4 pages; http://www.sherrardracks.com/photos.htm; Nov. 16, 2007.

Music Stands Alone; Tuba, Sousaphone Stands; Music Stands Alone; We Support Musicians Everywhere; 3 pages; http://www.musicstandsalone.com/tubasousaphonestands; Nov. 16, 2007.

* cited by examiner

CONVERTIBLE INSTRUMENT RACK

RELATED APPLICATION

The present application claims the benefit of U.S. Provisional Application No. 61/021,918 filed Jan. 18, 2008, which is incorporated herein in its entirety by reference.

FIELD

The present disclosure relates generally to storing musical instruments. More particularly, the present disclosure relates to a convertible instrument rack that can readily be converted to store at least two different kinds of musical instruments.

BACKGROUND

When not in use, musical instruments may require careful storage. In particular, inadvertent contact with walls, the floor, or other stored musical instruments can physically damage the instrument. Since such physical damage can adversely affect the performance qualities and value of the instrument, there is a need in the industry to carefully store musical instruments in a manner that minimizes damage.

Storage racks can themselves consume valuable storage space. As a result, it may be impractical to use individual storage racks for each instrument. In particular, institutions such as high schools may have limited storage space in which to store musical instruments and their respective racks when not in use. There is also a need in the industry to store multiple instruments at once.

In some instances, the number, type, and size of musical instruments used by an organization may vary. Such variance may depend upon particular performance needs or the availability of musicians who have the ability to play a particular instrument. For example, the number of tubas and sousaphones used in band performances may fluctuate from year-to-year. It may not be practically financially or logistically, however, to maintain multiple types of instrument racks to accommodate the seasonal or yearly changes in instrument needs or availability. Therefore, there is a need in the industry for a storage rack for musical instruments that can be converted to store multiple types of instruments, such as, for example, tubas or sousaphones. There is a further need in the industry for a musical storage rack that can be converted to store instruments of various sizes.

BRIEF SUMMARY

The embodiments of the present invention described herein substantially meet the aforementioned needs of the industry by providing a convertible instrument rack configurable to store sousaphones and/or tubas on the same rack. The configuration of the rack can also be readily changed to accommodate such a varying mix of instruments and instrument size.

In an embodiment, the convertible instrument rack includes a frame and a plurality of yoke sets. Each frame generally includes a side assembly and a base assembly, while each yoke set generally includes at least three yoke members. The base and side assemblies are generally made up of at least three support members coupled between a pair of side members and leg members. For example, two support members may extend between the leg members and one support member may extend between the side members. Stiffener members may be included to add structural support to the support members. Spacer members may be included for similar reasons as well as for dimensional qualities.

Each yoke set generally includes at least three yoke members. Each yoke member generally has a curved portion between two spaced-apart arms. The curved portion is adapted to receive a portion of a musical instrument, such as, for example, a tuba or a sousaphone, while the spaced-apart arms can limit lateral movement of the musical instrument within the yoke member. At least one yoke member is generally coupled to each of the three support member such that two yoke members are oriented toward the top of the convertible instrument rack and one yoke member is oriented toward the front of convertible instrument rack. In this manner, each yoke set can support a musical instrument above the floor. In addition, each yoke set generally limits movement of the musical instrument so as to prevent inadvertent contact with other stored musical instruments, An advantage of the present invention is the ability to adjust the respective positioning of each yoke member along three transverse axes. The axes can be generally orthogonally oriented with respect to each other. In this manner, the instrument is convertible so as to be able to provide storage for tubas and/or sousaphones, as well as tubas and/or sousaphones of different sizes.

In particular, each yoke member can be shifted longitudinally along a lateral support member and shifted transversely on either side of the lateral support member. In addition, the lateral support member itself can be shifted laterally to provide a third axis along which a yoke member can be shifted. With reference to a convertible instrument rack in an upright position and ready for use, each yoke member can thereby be moved upward or downward, forward or backward, and sideways.

In an embodiment, an instrument rack includes a frame, first and second support members, and first and second yoke members. The musical instrument includes a bell, a rounded tube section, and a tapered tube section intermediate the bell and the rounded tube section. The frame includes first and second spaced-apart frame members. Each frame member includes a base member and a side member. The first support member is disposed intermediate the base members of the first and second frame members. The second support member is disposed intermediate the base members of the first and second frame members. The first support member is spaced apart from the second support member. The first yoke member is adapted to receive a first portion of the rounded tube section. The second yoke member adapted to receive a second portion of the rounded tube section. Each of the first and second yoke members is selectively shiftable along at least three axes. In another embodiment, a method of storing a first musical instrument on an instrument rack includes providing first and second support members, coupling first and second yoke members to the first and second support members, respectively, and supporting the musical instrument with the first and second yoke members. Each of the first and second yoke members is selectively shiftable along at least three axes. Various other embodiments of the present invention are also contemplated.

DETAILED DESCRIPTION OF THE DRAWINGS

Figure 1A:
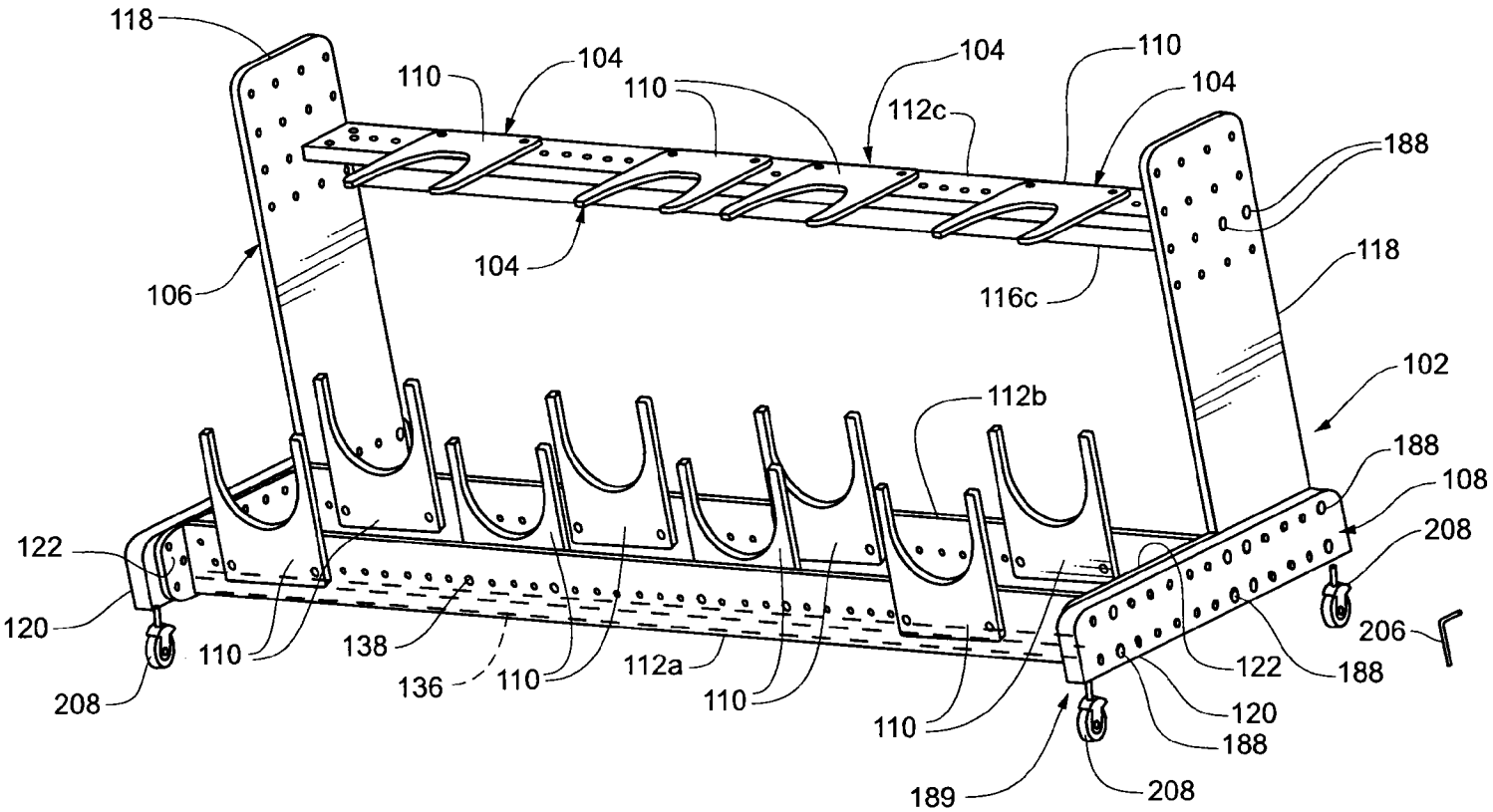
FIG. 1*a* is a perspective view of a convertible instrument rack according to an embodiment of the present invention.

A convertible instrument rack according to an embodiment is depicted generally in FIG. 1A with reference numeral 100. Although convertible instrument rack 100 may be used for any number of purposes, convertible instrument rack 100 can be used to store one or more musical instruments 101 according to an embodiment of the present invention.

Convertible instrument rack 100 generally includes frame 102 and at least one yoke set 104. In an embodiment, convertible instrument rack 100 includes three yoke sets 104, in FIG. 1B. In another embodiment, convertible instrument rack 100 includes four yoke sets 104. One skilled in the art will recognize that convertible instrument rack 100 may include any number of yoke sets 104 without departing from the spirit or scope of the present invention. For example, frame 102 could simply be extended and include additional yoke sets 104. Similarly, convertible instrument rack could be shortened and include fewer yoke sets 104.

Frame 102 of convertible instrument rack 100 generally includes side assembly 106 and base assembly 108. In an embodiment, side assembly 106 is operably coupled to base assembly 108.

Each yoke set 104 of convertible instrument rack 100 generally includes a plurality of yoke members 110. In an embodiment, yoke set 104 include at least three yoke members 110. It is understood that yoke set 104 may include additional yoke members 104. Each instrument can be supported by three yoke members 110. Accordingly, in the embodiment of convertible instrument rack 100 depicted in FIG. 1A, there are twelve such yoke members 110.

Referring to FIG. 1A, side assembly 106 generally includes support member 112*c*, stiffener member 116*c*, and side members 118. Base assembly 108 generally includes spaced-apart support members 112*a*, 112*b*, stiffener members 116*a*, 116*b* (not depicted in FIG. 1) leg members 120, and spacer members 122. Accordingly, convertible instrument rack 100 includes three support members 112*a*, 112*b*, 112*c* according to an embodiment of the invention. Each of stiffener members 116*a*, 116*b*, 116*c* is generally fixably coupled to respective support member 112*a*, 112*b*, 112*c*. In an embodiment, each of stiffener members 116*a*, 116*b*, 116*c* is disposed substantially at a right angle to each of respective support members 112*a*, 112*b*, 112*c*. Side assembly 106 or base assembly 108 may be adapted such that convertible instrument rack 100 includes additional support members 112 and/or stiffener members 116 without departing from the spirit or scope of the present invention.

In an embodiment, two side members 118 are generally upright in relation to leg members 120 to define the upper portion of convertible instrument rack 100. Each of side members 118 can be coupled to leg member 120. Each of leg members 120 projects generally forward from side members 18 to define the lower portion of convertible instrument rack 100. Each of spacer members 122 is coupled to the interior portion of respective leg members 120. In an embodiment, support members 112*a*, 112*b*, 112*c* and stiffener members 116*a*, 116*b*, 116*c* are substantially similar such they can be used interchangeably between spacer members 122 and side members 118.

Each support member 112 may present opposed sides 130, edge margins 132, and end margins 134. Each support member 112 also defines lower bores 136, center bores 138, and end bores 140. Lower bores 136, center bores 138, and end bores 140 are provided in pairs according to an embodiment.

Figure 3A:
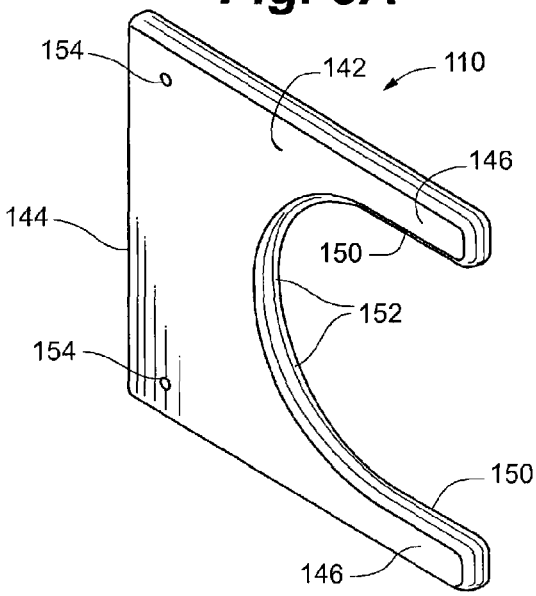
FIG. 3*a* is a perspective view of a yoke member of the convertible instrument rack of FIG. 1*a;*
Figure 3B:
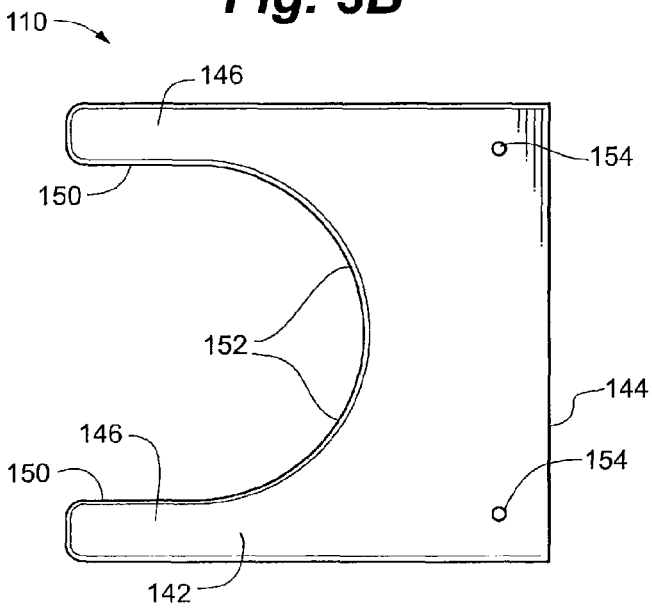
FIG. 3*b* is a side elevational view of the yoke member of FIG. 3*a;*
Figure 3C:
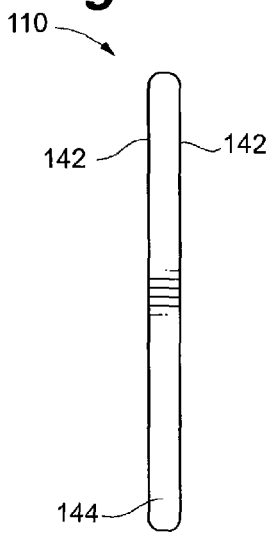
FIG. 3*c* is an end elevational view of the yoke member of FIG. 3*a;*

Referring to FIGS. 3*a*-3*c*, each yoke member 110 presents sides 142. Each yoke member 110 includes bottom portion 144, spaced-apart arms 146, straight portion 150, and curved portion 152. Each yoke member 110 generally also defines bores 154.

Figure 4A:
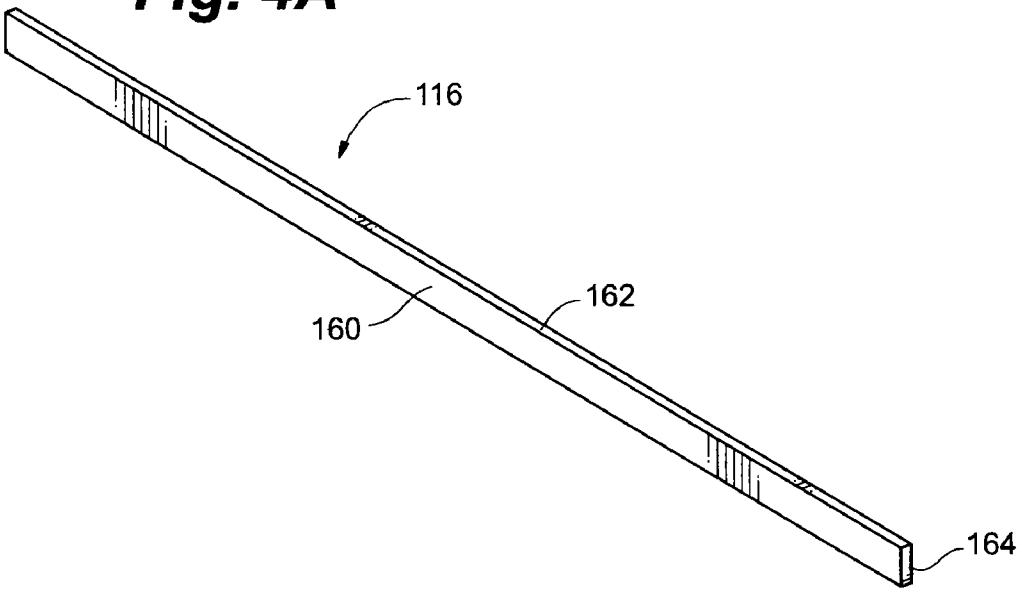
FIG. 4*a* is a perspective view of a stiffener member of the convertible instrument rack of FIG. 1*a;*
Figure 4B:
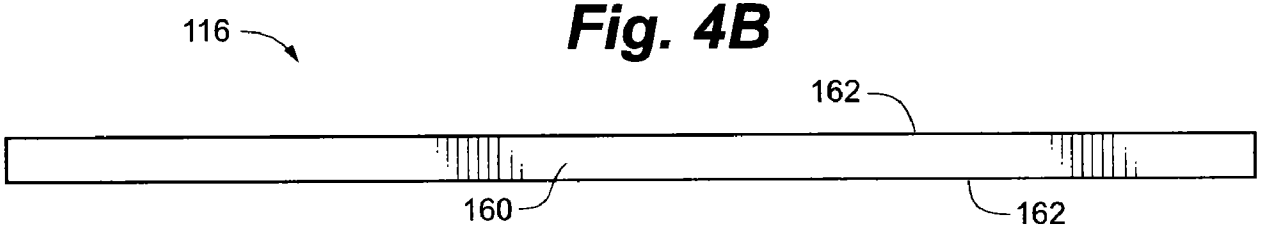
FIG. 4*b* is a side elevational view of the stiffener member of FIG. 4*a;*
Figure 4C:
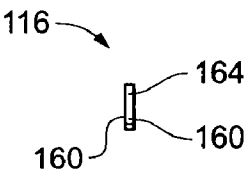
FIG. 4*c* is an end elevational view of the stiffener member of FIG. 4*a;*

Referring to FIGS. 4*a*-4*c*, each stiffener member 116 generally has opposed sides 160, edge margins 162, and end margins 164. In an embodiment, each stiffener member 116 is an elongate bar having a length dimension that can be co-extensive with the length dimension of support members 112.

Figure 5A:
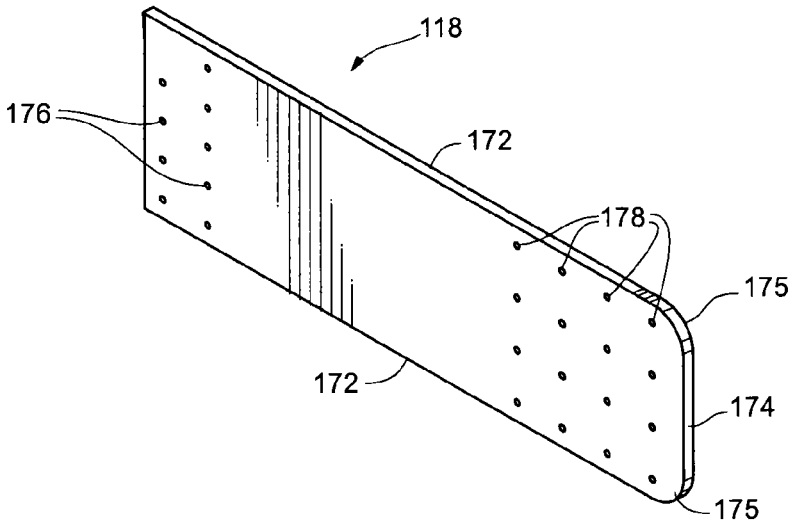
FIG. 5*a* is a perspective view of a side member of the convertible instrument rack of FIG. 1*a;*
Figure 5B:
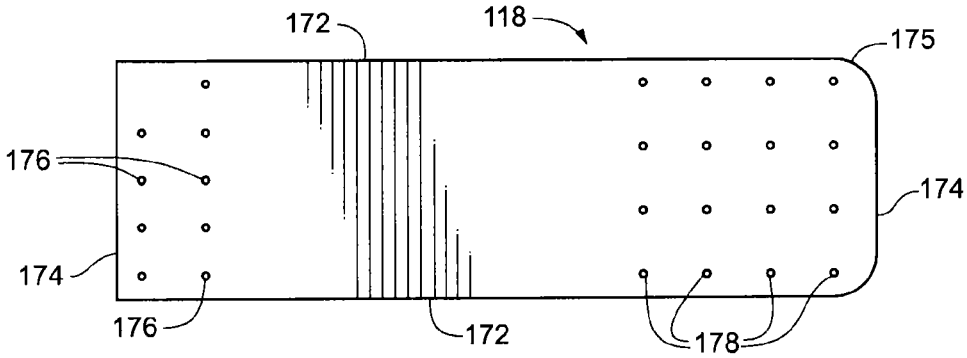
FIG. 5*b* is a side elevational view of the side member of FIG. 5*a;*
Figure 5C:
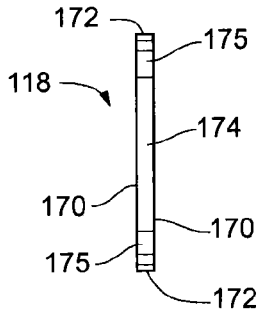
FIG. 5*c* is an end elevational view of the side member of FIG. 5*a;*

Referring to FIGS. 5*a*-5*c*, each side member 118 has opposed sides 170, edge margins 172, and end margins 174. Side members 118 may also include rounded comers 175 as a transition between respective edge margins 172. Each side member may further define a plurality of lower bores 176 and a plurality of upper bores 178.

Figure 6A:
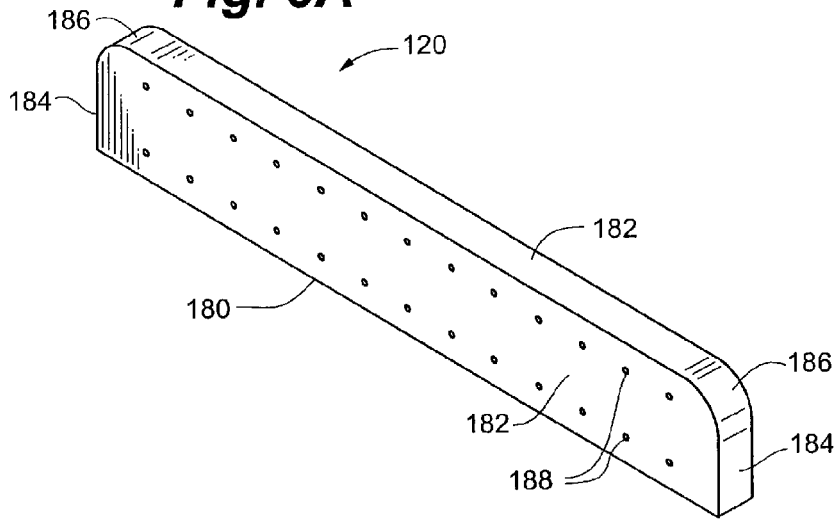
FIG. 6*a* is a perspective view of a leg member of the convertible instrument rack of FIG. 1*a;*
Figure 6B:
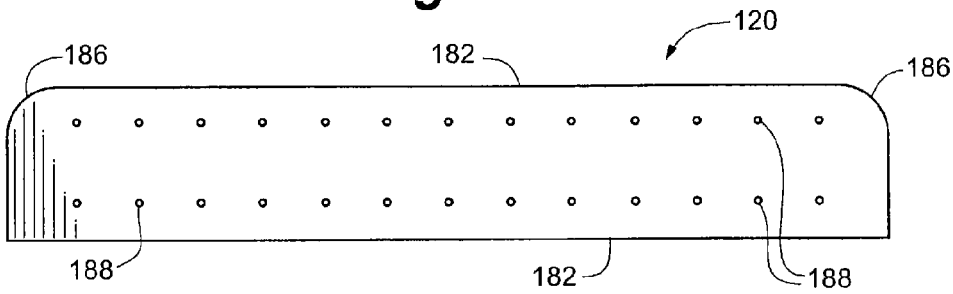
FIG. 6*b* is a side elevational view of the leg member of FIG. 6*a;*
Figure 6C:
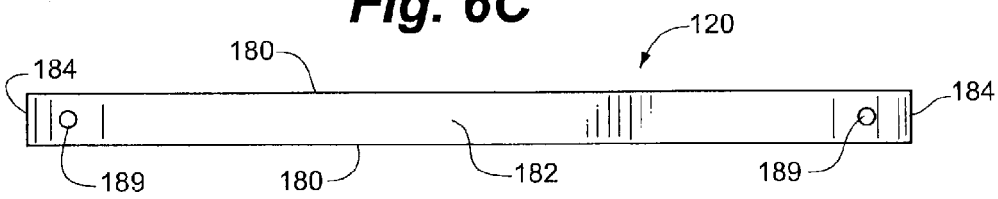
FIG. 6*c* is a bottom elevational view of the leg member of FIG. 6*a;*

Referring to FIGS. 6*a*-6*c*, each leg member 120 generally includes opposed sides 180, edge margins 182, and end margins 184. Leg members 120 may also include rounded corners 186 as a transition from upper edge margins 182 to respective end margins 184. Each leg member 120 may further define a plurality of bores 188 and caster bores 189.

Figure 7A:
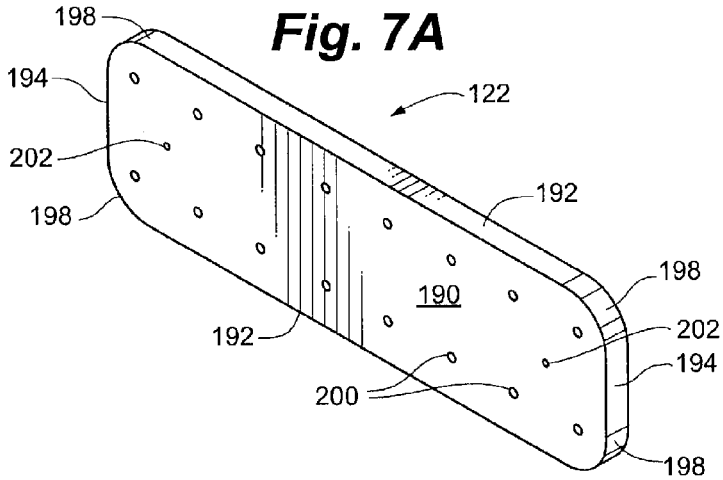
FIG. 7*a* is a perspective view of a side member of the convertible instrument rack of FIG. 1*a;*
Figure 7B:
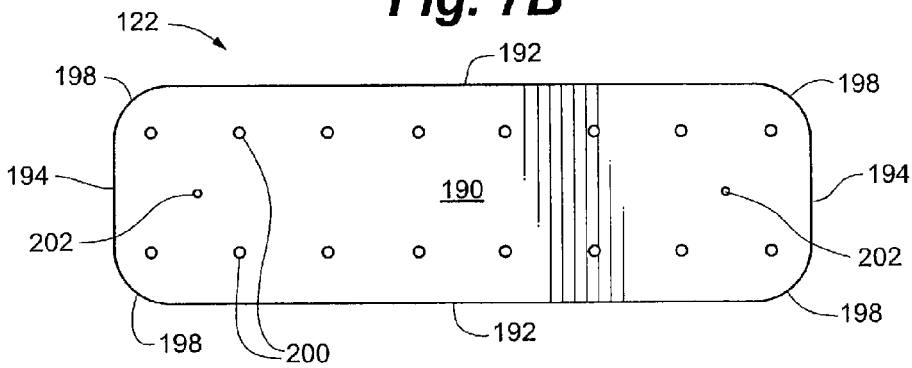
FIG. 7*b* is a side elevational view of the spacer member of FIG. 7*a;*
Figure 7C:
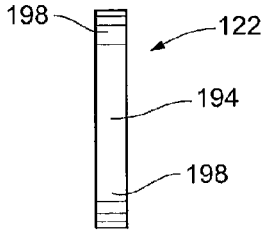
FIG. 7*c* is an end elevational view of the spacer member of FIG. 7*a;*
Figure 8:
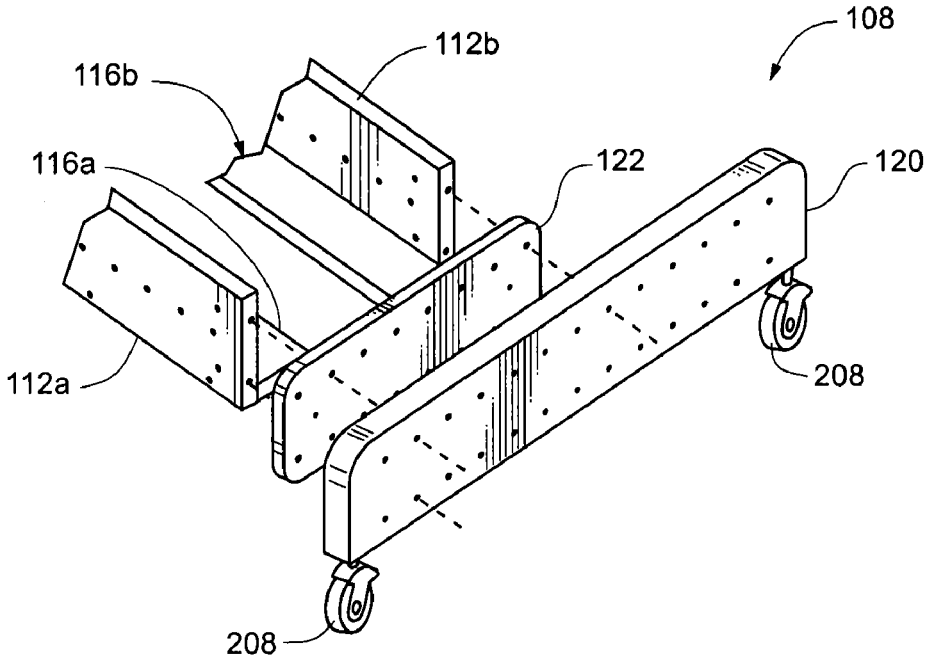
FIG. 8 is an exploded partial perspective view of a base assembly of a convertible instrument rack according to an embodiment of the present invention.
Figure 9:
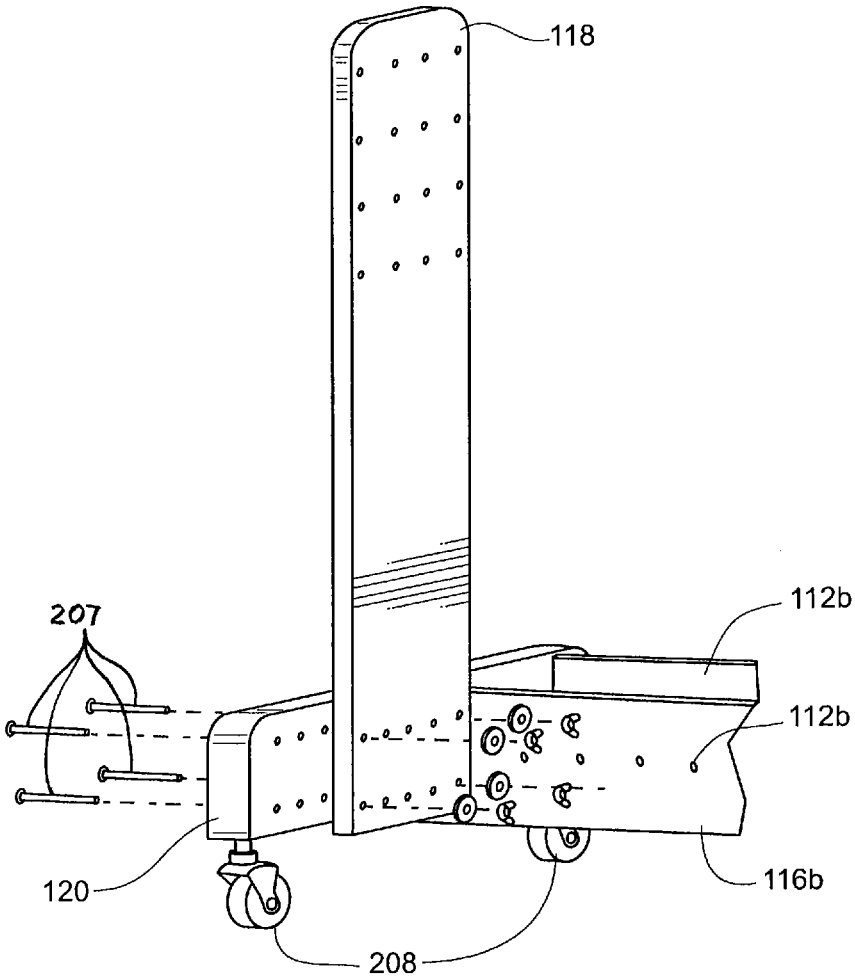
FIG. 9 is a partially exploded partial perspective view of a base assembly and side member of a convertible instrument rack according to an embodiment of the present invention.
Figure 10:
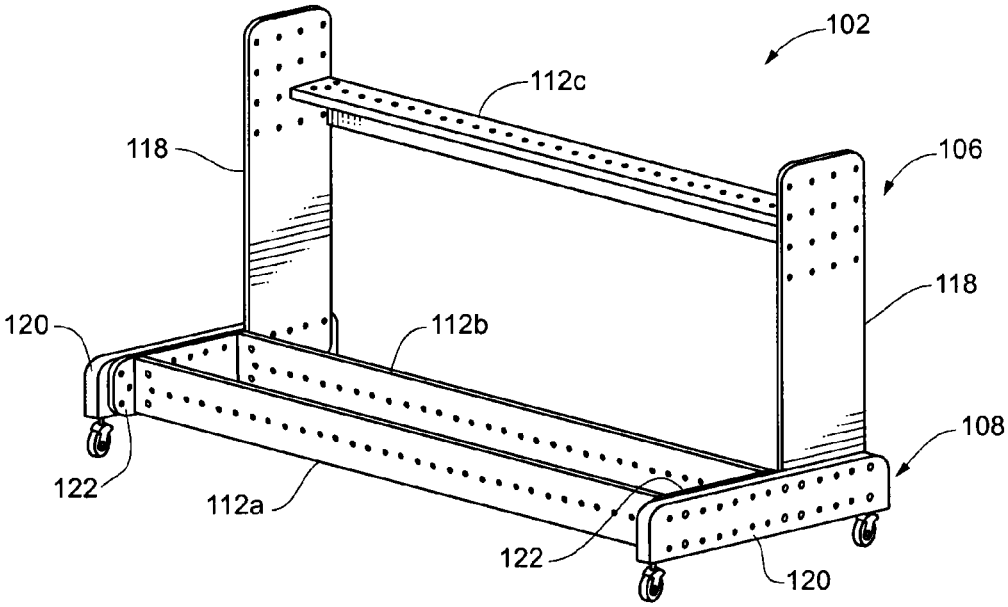
FIG. 10 is a perspective view of a frame assembly of a convertible instrument rack according to an embodiment of the present invention.
Figure 11A:
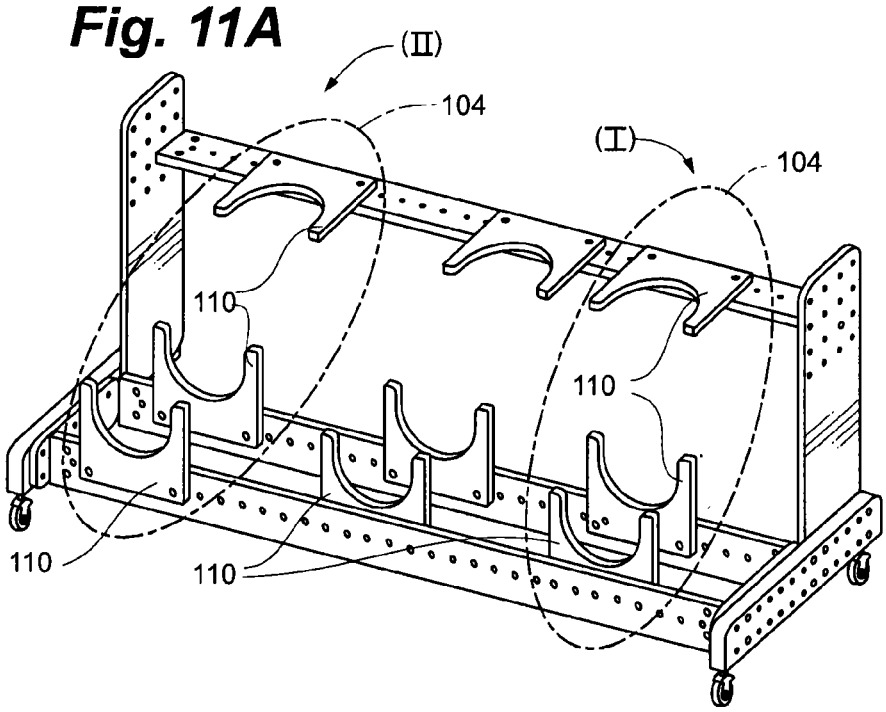
FIG. 11*a* is a perspective view of a convertible instrument rack according to an embodiment of the present invention.
Figure 11B:
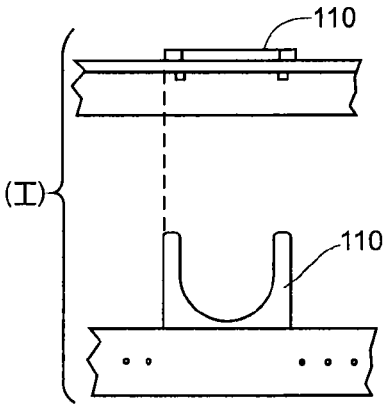
FIG. 11*b* is a partial front elevational view of section I of the convertible instrument rack depicted in FIG. 11*a;*
Figure 11C:
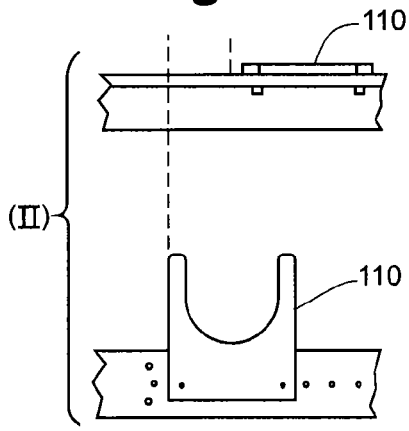
FIG. 11*c* is a partial front elevational view of section II of the convertible instrument rack depicted in FIG. 11*a;*
Figure 12:
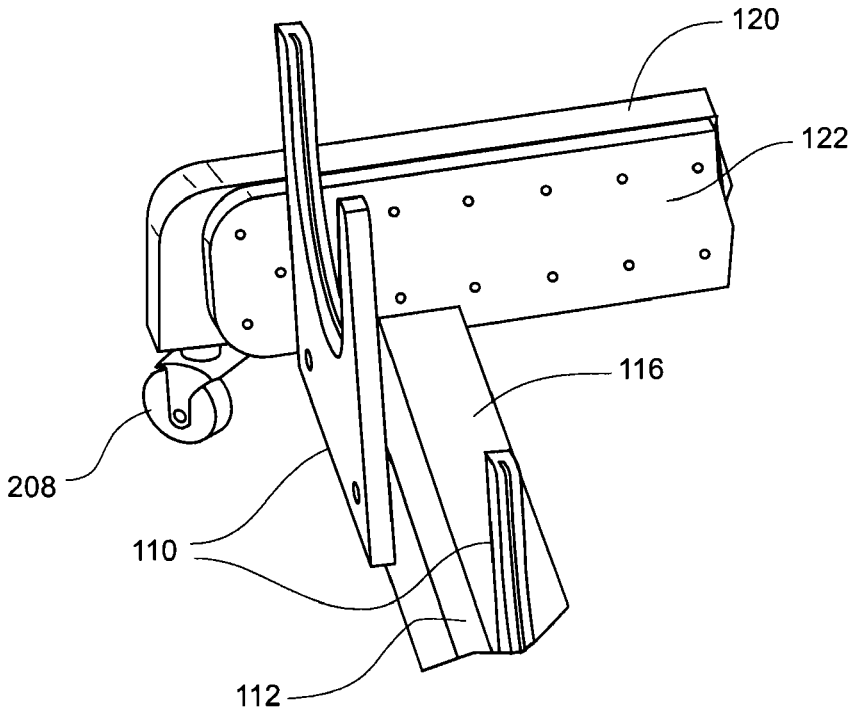
FIG. 12 is a partially exploded partial perspective view of a base assembly and a yoke of a convertible instrument rack according to an embodiment of the present invention.
Figure 13:
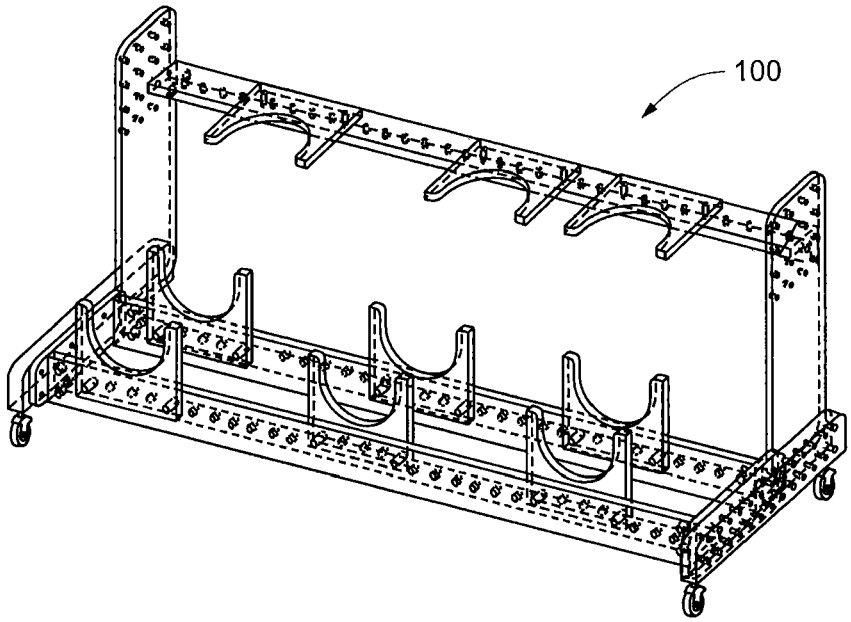
FIG. 13 is a phantom perspective view of a convertible instrument rack according to an embodiment of the present invention.
Figure 14:
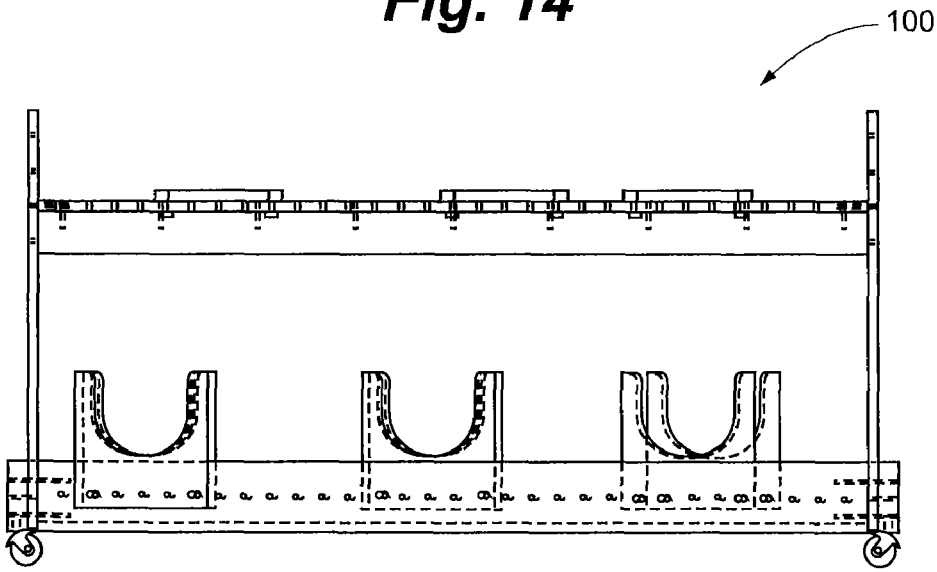
FIG. 14 is a phantom front or rear elevational view of a convertible instrument rack according to an embodiment of the present invention.
Figure 15:
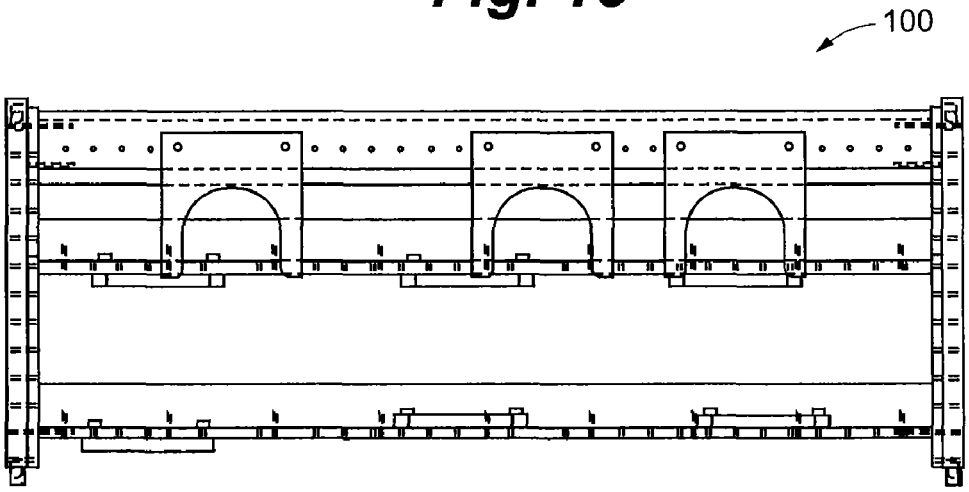
FIG. 15 is a phantom top or bottom elevational view of a convertible instrument rack according to an embodiment of the present invention.
Figure 16:
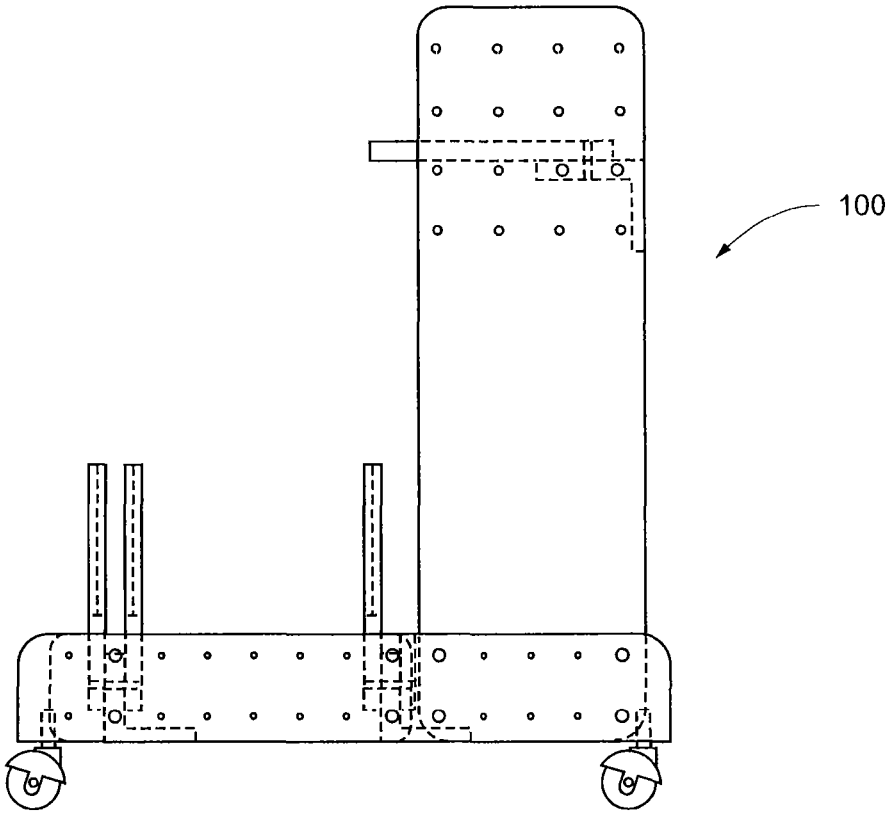
FIG. 16 is a phantom side elevational view of a convertible instrument rack according to an embodiment of the present invention.
Figure 17:
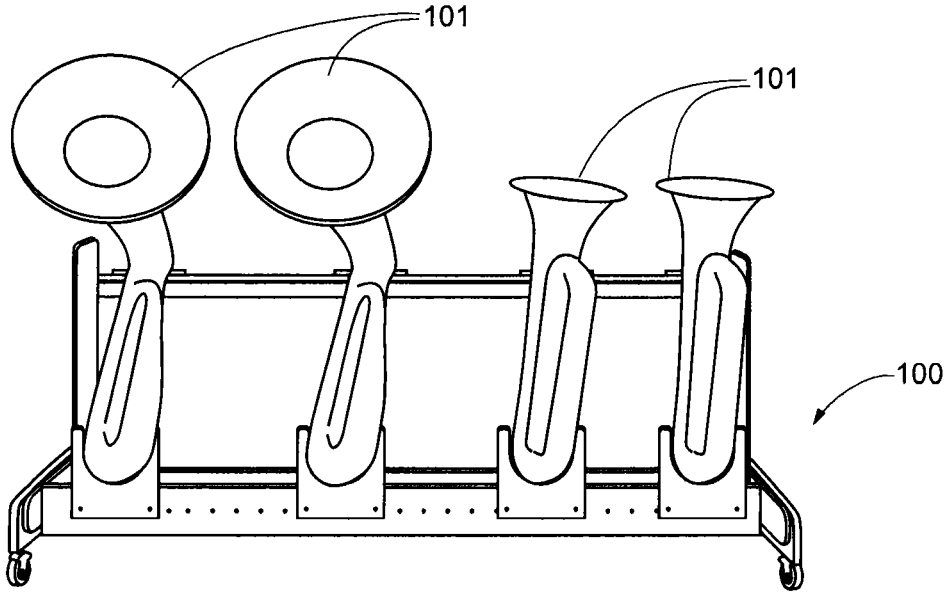
FIG. 17 is a perspective view of a convertible instrument rack according to an embodiment of the present invention depicted with several musical instruments.
Figure 18:
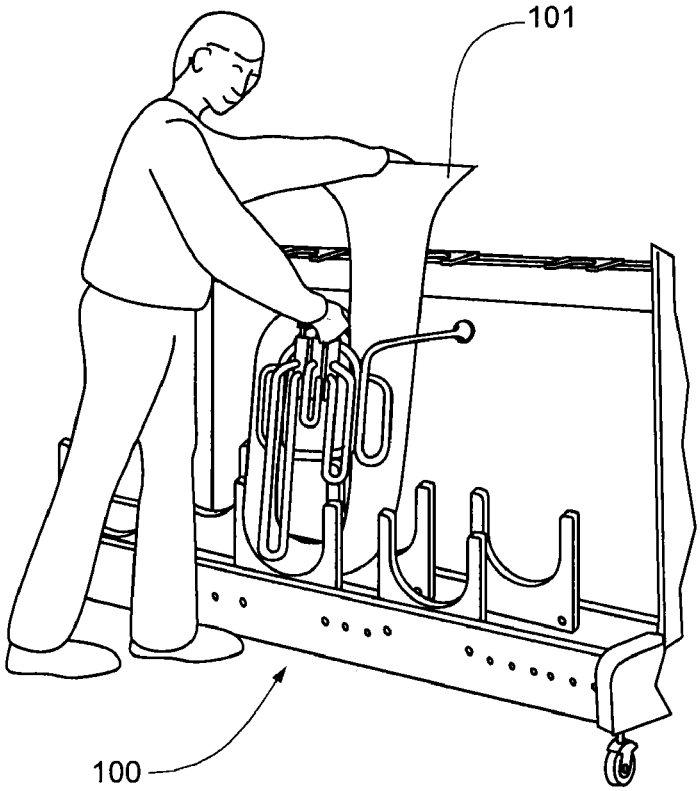
FIG. 18 is a partial perspective view of a convertible instrument rack according to an embodiment of the present invention depicted with a musical instrument.
Figure 19:
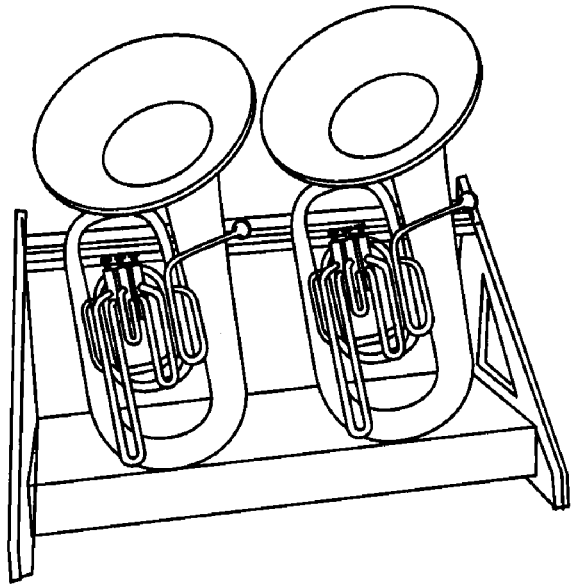
FIG. 19 is a perspective view of an instrument rack dedicated to storing tubas.
Figure 20:
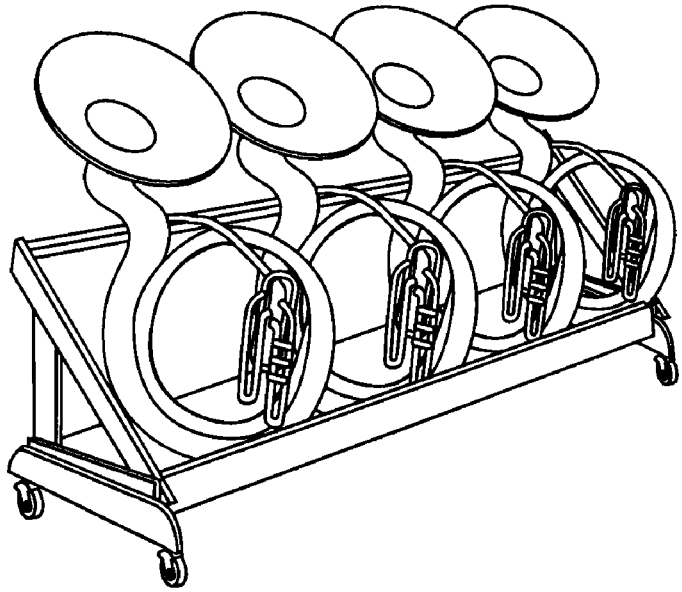
FIG. 20 is a perspective view of an instrument rack dedicated to storing sousaphones.

Referring to FIGS. 7*a*-7*c*, each spacer member 122 generally includes a pair of opposed sides 190, edge margins 192, and end margins 194. Each of the corners of the generally rectangular spacer members 122 can be a rounded corner 198. Each spacer member 122 generally defines bores 200 which are generally presented in rows. Each spacer member 122 may also define central bores 202 proximal to end margins 194.

Figure 2A:
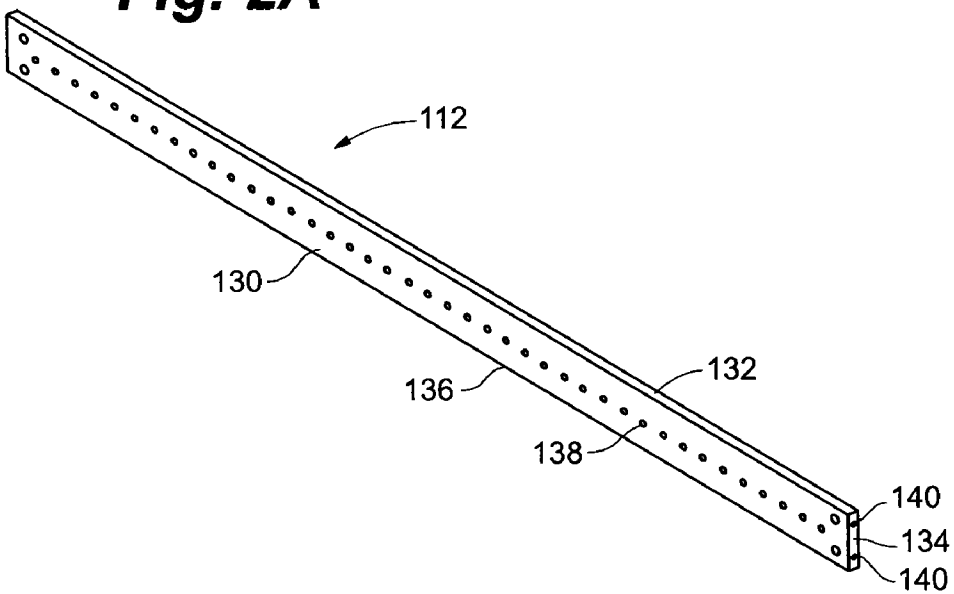
FIG. 2*a* is a perspective view of a support member of the convertible instrument rack of FIG. 1*a;*
Figure 2B:
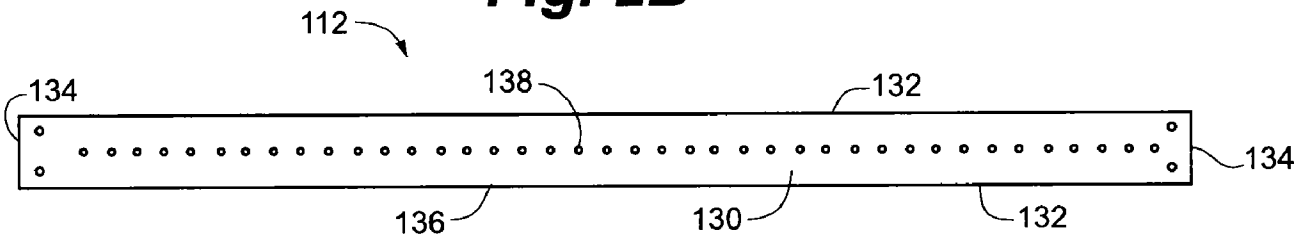
FIG. 2*b* is a side elevational view of the support member of FIG. 2*a;*
Figure 2C:
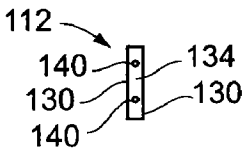
FIG. 2*c* is an end elevational view of the support member of FIG. 2*a;*

Referring to the embodiments of the present invention depicted in FIGS. 2*a*-*c*, each support member 112 is generally an elongate rectangular bar. In an embodiment, support member 112 can have a length of between approximately 1,000 mm and approximately 4,000 mm. In a further embodiment, each support member can have a length of approximately 2,438.40 mm, or approximately 8 feet. In an embodiment support member 112 can have a height of between approximately 50 mm and approximately 250 mm high. In a further embodiment, support member 112 can have a height of approximately 139.7 mm, or approximately 5.5 inches. In an embodiment, support member 112 can have a width of between approximately 10 mm and approximately 50 mm. In a further embodiment, support member 112 can have a width of approximately 25.40 mm, or approximately 1 inch. A person of ordinary skill in the art will recognize that dimensions in addition to those given above are contemplated and are within the present disclosure.

Referring to the embodiments of the present invention depicted in FIGS. 3*a*-3*c*, curved portion 152 of yoke member 110 is generally adapted to receive a portion of a musical instrument, such as, for example a tuba or a sousaphone. In embodiments, curved portions 152 of yoke members 110 may also be cushioned or contoured at points of contact with the instruments to help inhibit or prevent damage to the instruments according to further embodiments. In an embodiment, curved portion 152 of yoke member 110 has a radius of between approximately 50 mm and 300 mm. In a further embodiment, curved portion of yoke member 110 has a radius of approximately 150 mm. A person of ordinary skill in the art will recognize that dimensions in addition to those given above are contemplated and are within the present disclosure. Spaced-apart arms 146 extend generally opposite from bottom portion 144. Bores 154 are generally located proximal bottom portion 144. In embodiments, straight portion 150 and curved portion 152 of yoke member 110 can be beveled or cushioned.

Referring to the embodiments of the present invention depicted in FIGS. 5*a*-5*c*, side members 118 can have a height of between approximately 300 mm and approximately 1500 mm. In a further embodiment, side members 118 can have a height of approximately 914.4 mm, or approximately 3 feet. In an embodiment, side members 118 can have a width of between approximately 100 mm and approximately 800 mm. In an embodiment, side members 118 can have a width of approximately 285.8 mm. One of ordinary skill in the art will recognize that dimensions in addition to those given above are contemplated and are within the present disclosure. Side member 118 has a thickness dimension of 19.1 mm. In an embodiment, convertible instrument rack 100 has two rows of lower bores 176 with five bores per row. In an embodiment, convertible instrument rack 100 has four rows of upper bores 178 with four upper bores 178 per row. One of ordinary skill in the art will recognize that side members 118 may also contain additional rows of lower bores 176 or upper bores 178, and may contain additional lower bores 176 or upper bores 178 per row, without departing from the spirit or scope of the present invention.

Referring to the embodiments of the present invention depicted in FIGS. 6*a*-6*c*, leg members 120 can have a length of between approximately 300 mm and 1600 mm. In a further embodiment, leg members 120 can have a length of approximately 812.8 mm. In an embodiment, leg members 120 can have a height of between approximately 50 mm and approximately 350 mm. In a further embodiment, leg members 120 can have a height of approximately 139.7 mm. In an embodiment, leg members 120 can have a thickness of between approximately 15 mm and approximately 100 mm. In a further embodiment, leg members can have a thickness of approximately 44.5 mm. One of ordinary skill in the art will recognize that dimensions in addition to those given above are contemplated and are within the present disclosure. In an embodiment, each leg member 120 has two rows of bores 188. In an embodiment, caster bores 189 are positioned generally proximal end margins 184. One of ordinary skill in the art will recognize that side members 118 may also contain additional rows of bores 188 or 189 without departing from the spirit or scope of the present invention.

Referring to the embodiments of the present invention depicted in FIGS. 7*a*-7*c*, spacer member 122 has a length that is substantially less than the length of leg member 120 and a width that is substantially similar to the width of side member 118. In an embodiment, spacer member has a length between approximately 50 mm and 350 mm. In a further embodiment, spacer member 122 has a width of approximately 139.7 mm. One of ordinary skill in the art will recognize that dimensions in addition to those given above are contemplated and are within the present disclosure. In an embodiment, spacer members 122 have two rows of bores 200 with eight bores 200 per row. One of ordinary skill in the art will recognize that side members 118 may also contain additional rows of bores 188 or 189, and may contain additional or fewer bores 200, without departing from the spirit or scope of the present invention.

In operation, assembly of convertible instrument rack 100 can be understood with reference to FIG. 1. Although the following description provides for the assembly of convertible instrument rack 100 according to an embodiment, one skilled in the art will recognize that convertible instrument rack may be assembled in any number of ways without departing from the spirit of the present invention.

A respective spacer member 122 can be disposed on the interior forward portion of a respective leg member 120. Bores 200 of spacer member 122 can be brought into registry with bores 188 of leg members 120. Spacer member 122 can be secured in position with, for example, a screw-type fastener that passes through respective bores 200, 188 and into the structure of leg member 120. Stiffener member 116 can be then coupled to support member 112 with, for example, screw-type fasteners 207 passed through lower bores 136 defined in support member 112 and screwed into the structure of stiffener member 116. Support member 112-stiffener member 116 units can then be coupled to leg members 120. Fastener 207 can be passed through bores 200, 188 and into end bores 140 of support member 112. Fasteners 207 may comprise, for example, a bolt turned into place by means of an Allen wrench 206 or can be a dowel, as desired. Casters 208 can then be disposed in caster bores 189.

Once the lower portion of convertible instrument rack 100 is assembled, side members 118 can be affixed to the inner margins of leg member 210. Side members 118 can be abutted against respective rearward directed end margins 194 of spacer members 122. Such abutment brings bores 176, 188 into registry. Fasteners 207 can be then passed through bores 176, 188 of side members 118 to couple side member 118 to leg member 120.

With side members 118 in their upward directed disposition, such as depicted in FIG. 1, support member 112*c*, and stiffener member 116*c* unit can be extended between two spaced-apart side members 118 and secured into position with fasteners 207, such as previously described. The height of the support member 112*c*, and stiffener member 116*c* can be adjusted as desired by the selected row of bores 178 such that support member 112*c*, and stiffener member 116*c* is aligned therewith.

Figure 1B:
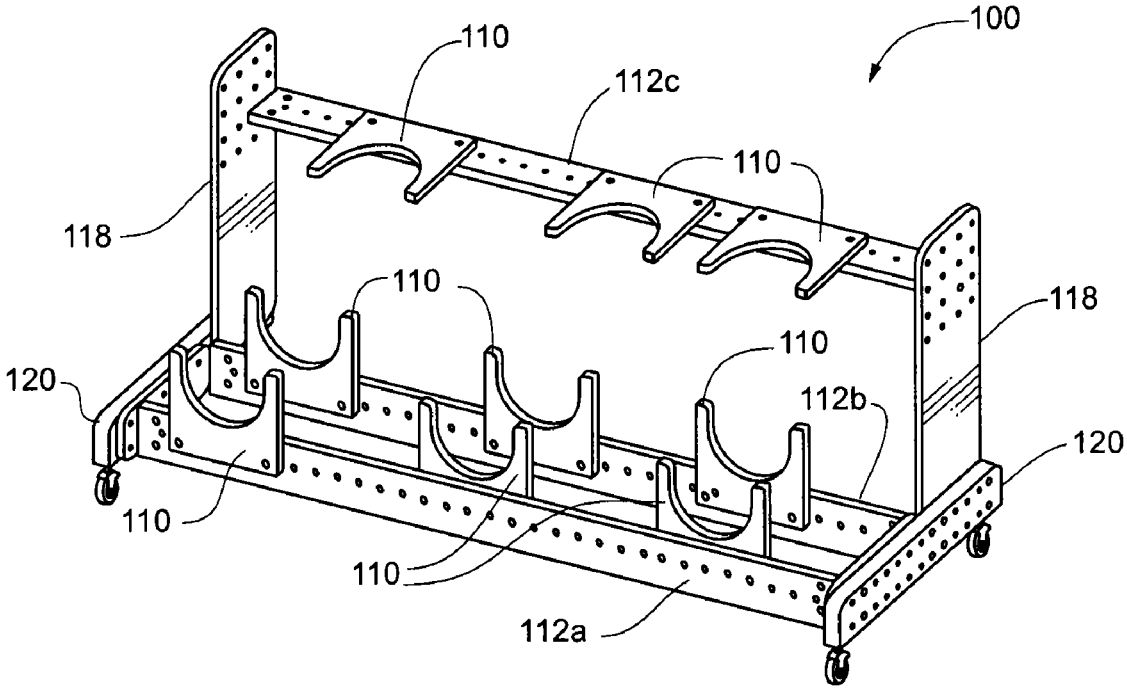
FIG. 1*b* is a perspective view of a convertible instrument rack according to an embodiment of the present invention.

With frame 102 of convertible instrument rack 100 assembled, yoke members 110 can be installed upon convertible instrument rack 100. A feature and advantage of the present invention is that variable installation dispositions of the various yoke members 110 and support members 112 generally provide the convertibility of convertible instrument rack 100. Referring to FIG. 1A or 1B, yoke members 10 can be disposed at various dispositions. Such variable dispositions allow the respective position of each yoke member 110 to be adjusted to as to accommodate different types of musical instruments and/or musical instrument of different sizes. In this manner, a first yoke set 104 on convertible instrument rack can be configured so as to receive and retain a tuba, for example, while a second yoke set 104 can be configured to receive and retain a sousaphone, for example.

In an embodiment, center bores 138 of support member 112 are brought into registry with bores 154 of yoke member 110. Fasteners 207 can then be inserted through bores 138, 154 to couple yoke member 110 to support member 112. While all yoke members 110 can be disposed on forward or rearward side 130 of rearmost lower support member 112*b*, yoke members 110 on the forward-most lower support member 112*a* can be disposed on varying sides 130 of lower support member 112*a*. Such variable disposition can thereby accommodate, for example, either a sousaphone or a tuba as desired. Either of the lower support members 112*a* or 112*b* can also be moved forward or rearward to fit larger or smaller instruments and to provide more secure support for instruments having varied centers of gravity (balance points).

Upper support member 112*c* and yoke members 110 can be adjusted up, down, forward, rearward, left, or right for best fit. By changing the lateral, vertical, and forward/rearward disposition of yoke members 110 and the disposition of yoke members 110 on the forward-most lower support member 112*a*, yoke sets 104 can be selectively configured to support, for example, a sousaphone or a tuba as desired.

Figure 21:
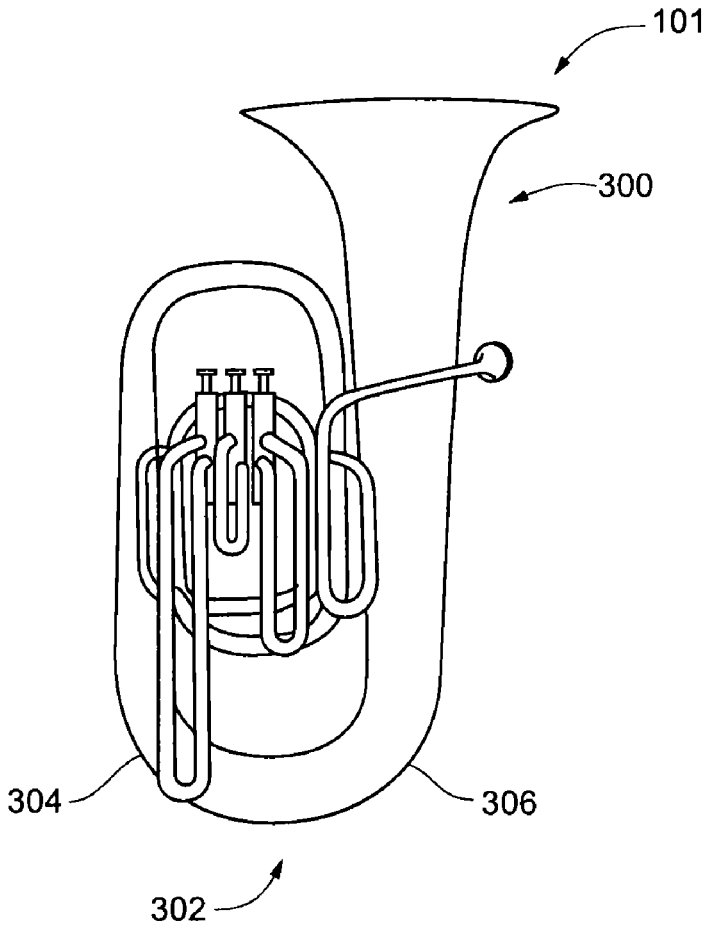
FIG. 21 is a side view of a musical instrument that can be stored on a convertible instrument rack according to an embodiment of the present invention.

In an embodiment, yoke members 110 can be adjusted to accommodate the various section of musical instrument 101 depicted in FIG. 21. For example, yoke members 110 could be used to support bell section 300 and rounded bottom portion 302 according to an embodiment. In a further embodiment, yoke members may support sections 304, 306 of rounded bottom portion 302 having different thicknesses and/or relative positions.

The embodiments above are intended to be illustrative and not limiting. Additional embodiments are within the claims. In addition, although the present invention has been described with reference to particular embodiments, those skilled in the art will recognize that changes can be made in form and detail without departing from the spirit and scope of the invention.

What is claimed is:

1. An instrument rack for storing a musical instrument, the musical instrument including a bell, a rounded tube section, and a tapered tube section intermediate the bell and the rounded tube section, the instrument rack comprising:

a frame including first and second spaced-apart frame members, each frame member including a leg member and a side member;

a first support member disposed intermediate the leg members of the first and second frame members;

a second support member disposed intermediate the leg members of the first and second frame members, the first support member being spaced apart from the second support member; and at least one first yoke member positionable on the first support member and adapted to receive a first portion of the rounded tube section, wherein the first yoke member is selectively shiftable along the first support member along at least a longitudinal axis of the first support member;

at least one second yoke member positionable on the second support member and adapted to receive a second portion of the rounded tube section, wherein the second yoke member is selectively shiftable along the second support member along at least a longitudinal axis of the second support member;

wherein the first support member is selectively shiftable on the frame to shift the first yoke member along at least longitudinal axes of both the leg members of the first and second frame members, respectively;

wherein the second support member is selectively shiftable on the frame to shift the first yoke member along at least the longitudinal axes of both the leg members of the first and second frame members, respectively;

a third support member disposed intermediate the side members of the first and second frame members; and at least one third yoke member adapted to receive a portion of the tapered tube section proximal to the bell while the first yoke member receives the first portion of the rounded tube section and the second yoke member receives the second portion of the rounded tube section, wherein the third yoke member is selectively shiftable along the third support member along at least a longitudinal axis of the third support member; wherein the third support member is selectively shiftable on the frame to shift the third yoke member parallel to and transversely to the longitudinal axis of each of the side members, respectively.

2. The instrument rack of claim 1, further comprising first, second, and third stiffener members coupled to the first, second, and third support members, respectively.

3. The instrument rack of claim 1, wherein each leg member is coupled to a spacer member, the first and second support member extending between the spacer members.

4. The instrument rack of claim 1, wherein each yoke member is substantially U-shaped.

5. The instrument rack of claim 1, wherein the musical instrument is selected from a group consisting of a tuba or a sousaphone.

6. The instrument rack of claim 1, wherein:

each support member defines a first row of support apertures;

each yoke member defines at least a pair of yoke apertures; and each of the at least a pair of yoke apertures can be brought into registry with at least two support apertures on any one of the support members.

7. The instrument rack of claim 6, wherein the at least a pair of yoke apertures can be brought into registry with at least two support apertures on either of two opposing sides of any one of the support members.

8. The instrument rack of claim 7, wherein each yoke member is shiftable along at least one of the rows of support apertures.

9. The instrument rack of claim 7, wherein at least one of the support members defines a second row of support apertures, the yoke being oriented between the first and second rows of support apertures in a direction substantially transverse to each row of support apertures.

10. The instrument rack of claim 1, wherein:

each base member defines at least two rows of leg apertures;

each of at least two opposing sides of the first and second support members defines at least a pair of support bores; and each of the at least a pair of support bores can be brought into simultaneous registry with at least two of the base apertures of the respective leg members.

11. The instrument rack of claim 10, wherein the first and second support members are shiftable along the at least two rows of base apertures.

12. The instrument rack of claim 11, wherein each leg member defines a third row of base apertures, the at least two support members being shiftable between the three rows of base apertures in a direction substantially transverse to each row of base apertures.

13. The instrument rack of claim 1, wherein:

each side member defines at least two rows of side apertures;

each of at least two opposing sides of the third support member defines at least a pair of support bores; and each of the at least a pair of support bores can be brought into simultaneous registry with at least two of the side apertures of the respective side members.

14. The instrument rack of claim 13, wherein the third support member is shiftable along the at least two rows of side apertures.

15. The instrument rack of claim 14, wherein each side member defines a third row of side apertures, the at least one support member being shiftable between the three rows of side apertures in a direction substantially transverse to each row of side apertures.

16. The instrument rack of claim 1, wherein each of the support members can be used interchangeably with another of the support members.

17. The instrument rack of claim 16, wherein each of the yoke members can be used interchangeably with another of the yoke members.

* * * * *

UNITED STATES PATENT AND TRADEMARK OFFICE

CERTIFICATE OF CORRECTION

PATENT NO. : 8,167,148 B2
APPLICATION NO. : 12/356925
DATED : May 1, 2012
INVENTOR(S) : Jacobson It is certified that error appears in the above-identified patent and that said Letters Patent is hereby corrected as shown below:

In the Specification

Column 2, Line 13:
Before "convertible instrument" insert --the--.

Column 3, Line 29:
After "view of a" delete "side" and insert --spacer--.

Column 4, Line 39:
After "yoke members" delete "104" and insert --110--.

Column 4, Line 65:
Before "to define" delete "18" and insert --118--.

Column 6, Line 1:
After "curved portion" insert --152--.

Column 7, Line 27:
After "leg member" delete "210" and insert --120--.

Column 7, Line 48:
After "yoke members" delete "10" and insert --110--.

In the Claims

Column 9, Line 38:
After "each" delete "base" and insert --leg--. After "rows of", delete "leg" and insert --base--.

Signed and Sealed this
Twelfth Day of November, 2013

Teresa Stanek Rea

Teresa Stanek Rea
*Deputy Director of the United States Patent and Trademark Office*